United States Patent [19]

Gonzalez Flores

[11] Patent Number: 4,514,941

[45] Date of Patent: May 7, 1985

[54] ASEISMIC SLIDERS

[76] Inventor: Manuel Gonzalez Flores, Uruapan 3, Mexico 7, D.F., Mexico

[21] Appl. No.: 334,397

[22] Filed: Dec. 24, 1981

Related U.S. Application Data

[63] Continuation-in-part of Ser. No. 35,192, May 2, 1979, abandoned.

[30] Foreign Application Priority Data

May 2, 1978 [MX] Mexico ..... 173291

[51] Int. Cl.[3] ..... E02D 27/34

[52] U.S. Cl. ..... 52/167; 14/16.1

[58] Field of Search ..... 52/167; 14/16.1; 308/6 R; 248/349, 638

[56] References Cited

U.S. PATENT DOCUMENTS

| | | | |
|---|---|---|---|
| 2,002,934 | 5/1935 | Collins | 52/167 |
| 2,014,643 | 9/1935 | Bakker | 52/167 |
| 4,330,103 | 5/1982 | Thuries et al. | 52/167 X |

*Primary Examiner*—Carl D. Friedman

*Attorney, Agent, or Firm*—Ladas & Parry

[57] ABSTRACT

An aseismic slide construction to isolate structures from horizontal ground movement caused by earthquakes comprises a lower plate for contact with the ground, an upper plate for supporting the structure, and a plurality of spherical balls located between the upper and lower plate. The balls are confined within a ring also located between the plates.

4 Claims, 2 Drawing Figures

ASEISMIC SLIDERS

The present invention is a continuation-in-part application of application Ser. No. 35,192 filed on May 2, 1979, now abandoned.

It refers to an improved aseismic device to be used in buildings, bridges and in generally big structures that need a means to lessen the effect of seismic waves or motion. It particularly refers to a three-layered structure consisting of an upper plate, a lower plate and a plurality of balls held together by a displaceable ring located therebetween. Said layered structure provides for the lower plate sliding movement to be minimally transmitted to the upper plate by means of the said balls' rolling action, thereby effectively isolating a given structure from horizontal ground movement.

BACKGROUND

Seismic action is a safety hazard which has prompted many inventive solutions. The nature of earthquakes and of seismic activity in general calls for systems or devices which transmit the least possible movement to the building being thereby protected. In this regard perhaps the most pertinent systems and which are somewhat similar or related to the instant invention—are the ones disclosed in U.S. Pat. Nos. 2,014,643 and 864,249.

Of the aforementioned, there is a commonly envisioned solution to isolate a building from ground movement, and that is the use of the balls that will roll when one of the surfaces moves with respect to the other, and thereby keep one of said surfaces from moving.

The principle is a round one as such, but laboratory tests have shown that additional embodiments are necessary to make this principle workable.

The present invention incorporates several practical solutions to new problems and behaviour which became evident during the development stages of the invention. For one, for the balls to roll as a group when the lower plate moves, said balls must be located close together but with a clearance between same. Also, the overall proportions must provide a sliding area that will not let the group of balls fall off the rolling surface. It has also been found profitable to enclose the group of balls within a circular displaceable ring having a circular cross-section. The ring helps locate the balls within a specific area and provides for the balls to be mutually spaced-apart as if individually located in a beehive structure, thus allowing an hexagonal disposition of the balls. The system is immersed in oil to, among other factors, diminish friction. This helps the ring slide easily on a horizontal plane when pushed by the outer orbit of balls. The ring's cross-section is of a diameter smaller than that of the balls to ensure that said ring never contacts the upper plate nor obstructs in any other way.

The great majority of an area affected by an earthquake receives shock waves that come very nearly to the horizontal plane. This holds true in all cases, except for the area lying exactly atop or rather close to the earthquake focus. It is also evident that a given earthquake isolating system must be completely adaptable to the specific geographic (geological) area where it will be implemented. The latter is very important if a safety margin is to be built into the system. For example, if the system or device ist to be used in an earthquake-prone area such as the State of California, U.S.A. research data must point out the general characteristics of the earth movements that are likely to occur. The aseismic device must be capable of providing its specific aseismic function along with a safety margin. Furthermore, it should be able to withstand varying or unwarranted earth movements without loss of its functional characteristics.

Figure 1:
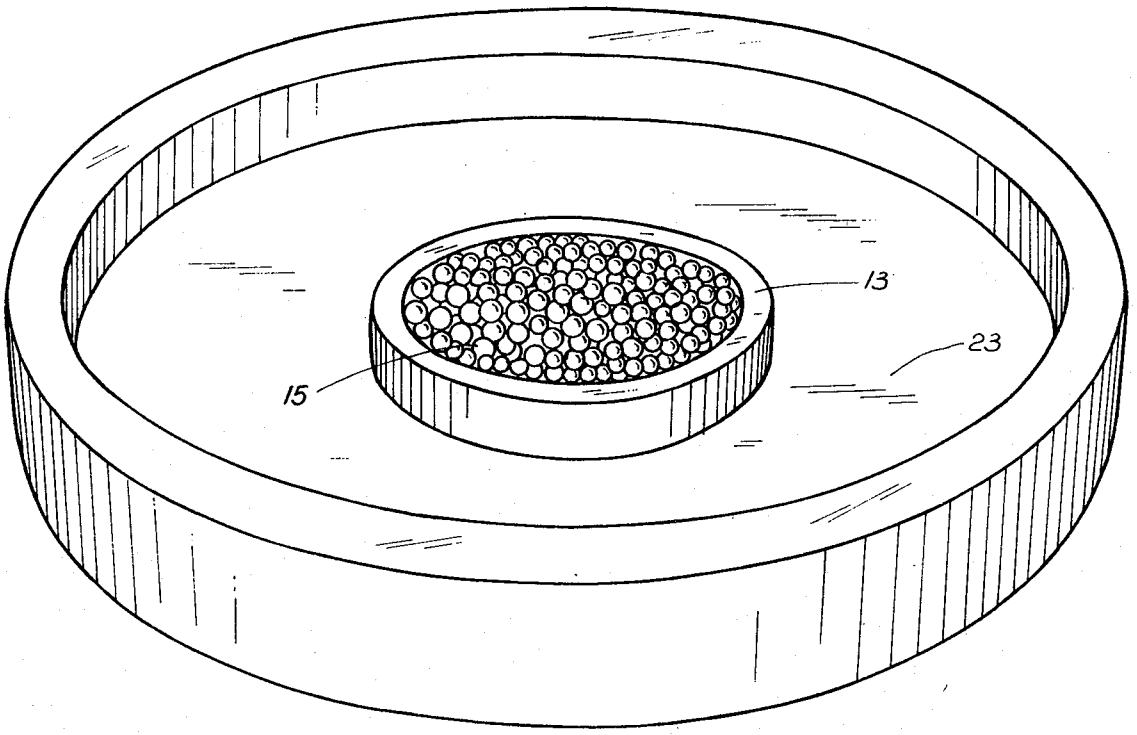
FIG. 1 is a perspective view of the slider system.
Figure 2:
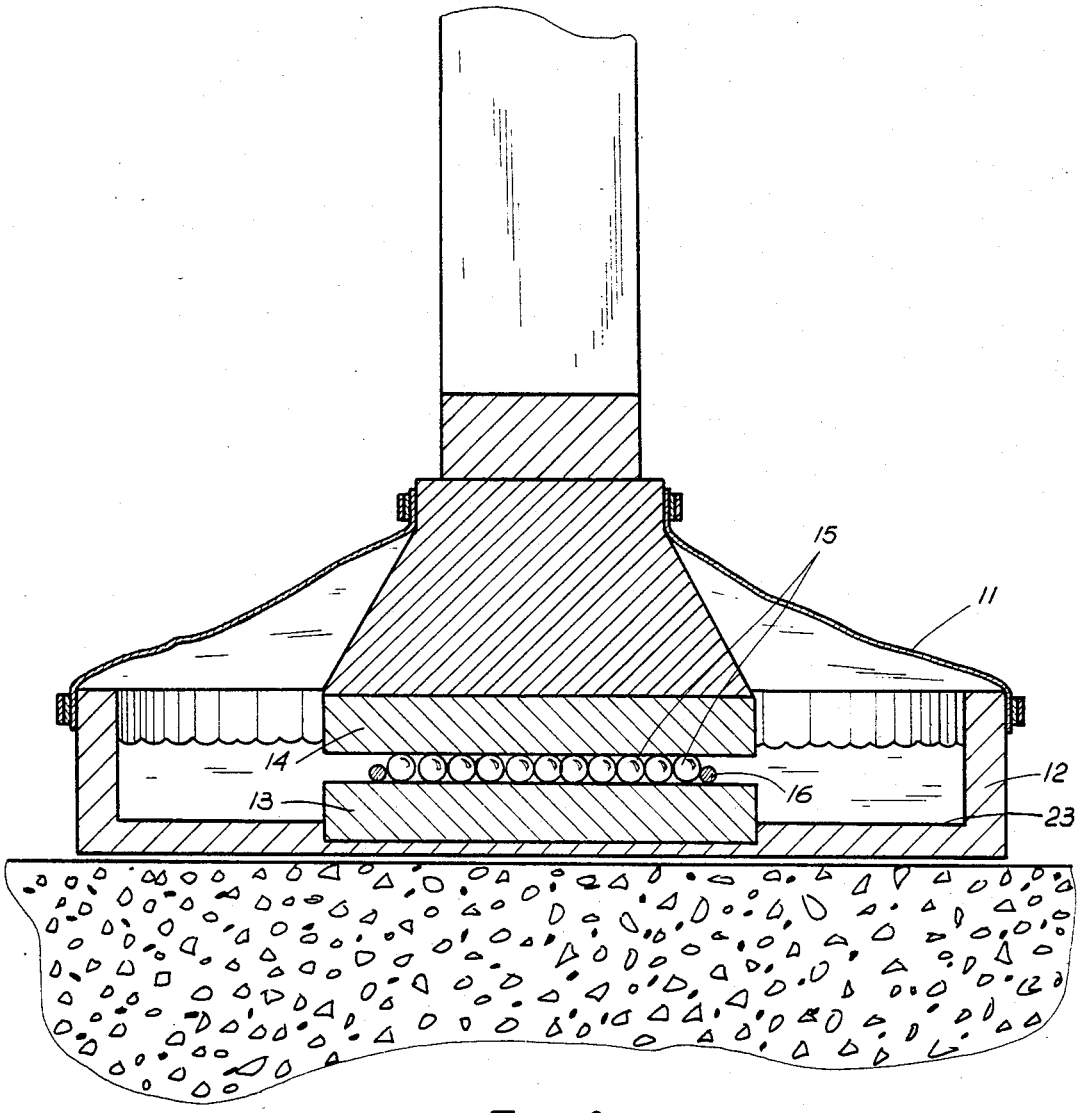
FIG. 2 is a side cross-sectional view of the slider on location.

The aseismic slider of the present invention consists of a lower plate (13) having an upper smooth surface and of an upper plate (14) having a lower smooth surface. Located between said two upper and lower plates is a plurality of balls (15) radially enclosed by displacement ring (16). Said ring (16) merely rests on the same lower plate surface (13) but does not contact the lower smooth surface of said upper plate (14).

Balls (15) separate both plates and allow for free sliding movement therebetween. The ring encloses said group of balls (15).

The system is enclosed in a wholly lubricated space defined by sidewall (12), surface (11) and nether surface (23) which receives lower plate (13).

I claim:

1. An improved aseismic slider construction for a building or other large structure to isolate the structure from horizontal ground movement resulting from seismic waves caused by earthquakes, including supporting means for the structure having a sliding element adapted to slide when horizontal ground movement occurs and to maintain the structure substantially free from horizontal movement due to its inertia; in which the improved construction comprises three horizontal portions, including a lower plate for contact with the ground, an upper plate for supporting the building structure, and a plurality of identical hard spherical balls located between and contacting said upper and lower plates, said balls being confined to the area within a ring member also located between said plates and extending over and contracting each other in said area, said ring member being free to move together with the balls.

2. An improved aseismic slider construction as set forth in claim 1 in which said ring member rests on the lower plate, but does not contact the upper plate.

3. An improved aseismic slider construction as set forth in claim 1 in which the area defined by the ring-confined balls is substantially smaller than the area of said plates.

4. An improved aseismic slider construction as set forth in claim 1 which said three horizontal portions are enclosed in a lubricated space.

* * * * *